US006669063B1

(12) United States Patent
Schneider et al.

(10) Patent No.: US 6,669,063 B1
(45) Date of Patent: Dec. 30, 2003

(54) METHOD FOR IRREVERSIBLY FIXING A CAP ON A CONTAINER HEAD ENABLING A LIMITED ROTATION OF SAID CAP ON SAID HEAD

(75) Inventors: Bernard Schneider, Sainte Menehould (FR); Herve Bodet, Verdun (FR); Jean-Baptiste Vicchi, Sainte Menehould (FR)

(73) Assignee: Pechiney, Lyons (FR)

( * ) Notice: Subject to any disclaimer, the term of this patent is extended or adjusted under 35 U.S.C. 154(b) by 0 days.

(21) Appl. No.: 09/807,989

(22) PCT Filed: Oct. 26, 1999

(86) PCT No.: PCT/FR99/02593

§ 371 (c)(1),
(2), (4) Date: Jul. 24, 2001

(87) PCT Pub. No.: WO00/26105

PCT Pub. Date: May 11, 2000

(30) Foreign Application Priority Data

Nov. 3, 1998 (FR) ..... 98 13962

(51) Int. Cl.[7] ..... B67D 3/00
(52) U.S. Cl. ..... 222/521; 222/519
(58) Field of Search ..... 222/521, 520, 222/519, 562, 563, 525; 215/216, 220, 320

(56) References Cited

U.S. PATENT DOCUMENTS 3,175,741 A * 3/1965 Porter ..... 222/521
3,273,754 A * 9/1966 Lindley ..... 222/92
4,149,646 A * 4/1979 Julian ..... 215/216
4,805,807 A * 2/1989 Perne et al. ..... 222/153.06
4,817,831 A * 4/1989 Theisen ..... 222/499
4,964,548 A * 10/1990 Kenyon, Jr. ..... 222/521
5,186,369 A * 2/1993 Aguirrezabal ..... 222/521
5,199,605 A * 4/1993 Schneider ..... 222/25
5,305,932 A * 4/1994 Iseli ..... 222/521
6,062,441 A * 5/2000 Mengeu et al. ..... 222/521
6,543,650 B1 * 4/2003 Sprick et al. ..... 222/153.14

FOREIGN PATENT DOCUMENTS

FR 2708570 A1 * 2/1995 ..... B65D/47/22
GB 0520118 A1 * 12/1992 ..... B65D/47/24
GB 0558273 A1 * 9/1993 ..... B65D/47/24

* cited by examiner

*Primary Examiner*—Gene Mancene
*Assistant Examiner*—Frederick C. Nicolas
(74) *Attorney, Agent, or Firm*—Dennison, Schultz & Dougherty

(57) ABSTRACT

A The invention discloses an assembly consisting of a head (1, 1', 200) and an overcap (30, 30', 30", 300), the head having a cylindrical neck provided with a helical screw thread (21), the overcap having a cylindrical skirt (31) provided with a thread (36) matching the neck thread (21). The overcap carries an axial plate (33) radially flexible and circumferentially rigid. The neck base (10) is provided with at least an opening stop (12), and at least a closure stop (11), of lesser height. When the overcap (30) is screwed on the head for mounting the assembly, the free end of the axial plate is urged into contact with a first wall (14) of the opening stop (12) and the axial plate whereof the free end is urged by a centrifugal motion, is elastically deformed then, folds down towards the neck in a space between the opening (12) and closure (11) stops, its displacement being thereby restricted.

24 Claims, 4 Drawing Sheets

METHOD FOR IRREVERSIBLY FIXING A CAP ON A CONTAINER HEAD ENABLING A LIMITED ROTATION OF SAID CAP ON SAID HEAD

TECHNICAL FIELD

The invention relates to a system for fixing a cap on a container head on which there is a neck surrounding a distribution orifice. This system enables an irreversible attachment in the sense that the said cap cannot be detached from the assembly without deliberately applying large forces that could at least partially damage the head and/or the overcap. But this attachment is not a complete immobilization; when fixed, the overcap can be moved in a circular or helical movement with a limited amplitude with respect to the centreline of the neck in the head.

STATE OF THE ART

The use of this type of head is known for "quarter turn" or "centerlock" containers, which can be partially unscrewed to move the top of the cap away from the top of the head and thus release a central orifice through which the product can be distributed.

Thus, U.S. Pat. No. 5,199,605 registered by the applicant describes a distributor for cream or paste products comprising a rigid head fixed onto a body or a skirt and an overcap. The following description uses the same references used in the figures in U.S. Pat. No. 5,199,605. The head (1) and the overcap (2) comprise complementary screwing means (9 and 19) that rotate relative to each other to raise or lower the overcap with respect to the head. The overcap is provided with a central opening (14) and the top end of the head is in the form of a cylindrical neck (5) through which the product passes, closed by a closer (3) supported by tabs (4) fixed to the inside wall of the neck. The closer closes the central opening of the overcap when this overcap is in the down position.

Rotation is limited firstly by the end of the thread at the end of screwing in, and secondly by pads (24) located on the shoulder (11) of the distributor when screwing out and that work in cooperation with the ends (26 and 25) of axial reinforcing ribs (260 and 250) of the skirt (16) of the overcap. The shapes of the ends (25) and (26) are different. The end (25) is small but rigid, and stops in contact with a pad (24) that participates in blocking at the end of screwing in and protects the end of the thread. The end (26) is a circumferentially flexible plate that is fixed from above (240) by a pad (24) and is then suddenly released, and which vibrates and acts as a warning at the end of screwing out. The blocking means used are only efficient if the forces applied are small, particularly due to their size and the low stiffness of the assembly. Due to the warning, the user reduces and then stops applying a force when the overcap is close to a stop.

PROBLEM THAT ARISES

It is difficult to manufacture the distributor described above, particularly due to moulding of the central part of the head, namely the closer held in place at the end of the tabs fixed onto the internal wall of the neck. The tooling is complex, particularly to make the arms that hold the closer in place, which have to be as thin as possible so that the product can pass through easily—and consequently cannot be used as feed ducts for the plastic material leading from a central injection point. In this case, peripheral injection is necessary at several points around the wall of the neck, and the wall cannot be as thin as would have been desirable.

Furthermore, safety when screwing out remains uncertain despite the audible warning. The applicant considered replacing the "pad—end of grooves" device by a device such as that proposed in EP 0 633 197 in which, during screwing out, a flexible axial plate (12) fixed to the overcap reaches a stop in contact with a profiled axial portion (14) attached to the shoulder of the distributor. Another profiled axial portion (15) acts as a stop with a plate (12) that is flexible in the screwing in direction. In the case of EP 0 633 197, the objective is to make axial portions (14) and (15) as close to each other as possible to fix the overcap firmly in place. Moving the profiled axial portions (15) and (14) away from each other enables a limited relative rotation of the overcap and the head. But these profiled axial portions are thick and high which further increases the weight of plastic material to be injected on the head, which has a particularly negative effect on production rates, particularly when the head is directly insert moulded on the skirt or the body of the container, in other words when the head is fixed to the body or the skirt at the same time that it is injected.

Finally, the thick and heavy head makes the tube cumbersome to handle, which is not appreciated by the user of the container. The size of a device that cannot be unscrewed accidentally and with limited rotation such as any of the devices according to prior art is such that it is impossible to equip the head with other means that could perform other functions.

For example, it would be necessary to improve the stop at the end of screwing in since the flexibility of the plastic materials used for the neck and the overcap means that if the end of screwing in force is not controlled, the helical thickening forming the thread can easily skip from one helical groove to the next, with sudden movements of the overcap with respect to the head.

The seal provided by a system such as the "centerlock" is not excellent. For applications such as cosmetic or pharmaceutical products packaged in flexible tubes, it is usually necessary to use an outer cover to prevent unwanted leaks, particularly when these tubes are transported in a carry bag. Apart from the additional cost, the use of an outer cover further slightly increases the weight of the container at its distribution head. No solution based on the "centerlock" principle has been considered up to now for products sensitive to ambient air such as cyanoacrylate glues, due to the excessive risk of glue setting in the distribution orifice.

Therefore, the applicant attempted to develop a lightweight head+overcap assembly that is compact and easy-to-inject, in which the overcap is irreversibly fixed to the head in the axial direction and to which a limited rotation can be imposed, in other words by blocking the overcap in clearly defined positions when screwing in and screwing out. The weight reduction and the compactness of this fixing system not only makes containers according to prior art easier to use, they also make it possible to create new containers for more demanding applications, particularly for impermeability of the closure, by the addition of elements that perform other functions.

Purpose of the Invention

FIG. 1 diagrammatically shows the various attachment means to facilitate understanding of the description of the invention. It shows a top view of a head above a cylindrical wall (50) provided with attachment means (11, 12, 15)

cooperating with the attachment means (33 and 34) on the overcap, the other parts of the said overcap not being shown.

The purpose of the invention is a container head and overcap assembly, the said head having one end open and designed to be fixed on the open ends of a container or flexible tube fitted with a cylindrical neck (20) and a shoulder (3) extending from the said open end to the base (10) of the neck, in which the cylindrical neck is provided with at least one helical screw thread (21) with pitch P and in which the overcap has a cylindrical skirt (35) provided with a screwing in means (36) on its inner wall complementary to the screwing in means on the neck. The overcap has a top wall (46) on which at least one radially flexible and circumferentially rigid axial plate (33) is fixed. The other end of this flexible plate is free. The plate is located at a distance from the centreline of the overcap that is slightly greater than the outside radius of the neck. The bottom of the neck is provided with at least one opening stop (12) with angular position $\theta$, and at least one closure stop (11) with angular position $\phi$ that is not as high, the said opening stop being provided with a first wall (14) that gradually moves away from the cylindrical wall of the said neck, such that when the overcap is screwed onto the head for putting the assembly together, the free end of the axial plate (33) comes into contact with the first wall (14) of the opening stop (12) and in that the axial plate (33), the free end of which is moved centrifugally, is elastically deformed. After passing beyond the angular position $\theta$, the flexible plate (33) moves beyond towards the wall of the neck in a space between the said opening and closure stops, and in this case its movement is limited by the blocking walls (16 and 17) of the stops (11 and 12).

The axial plate (33) is radially flexible in the sense that its free end moves elastically under the effect of a small force in the radial direction and is circumferentially rigid in the sense that a very large force has to be applied to move this free end in the orthoradial direction, and this force is sufficiently high to cause irreversible deformation or breakage of the said plate.

Preferably, the axial plate (33) matches the shape of a portion of the ring with an opening angle 5 and average radius slightly greater than the radius of the neck. Its orthogonal section is a curved trapezium in which the small base and the large base are arcs of a circle, the large base being on the inside. The small base and the large base are associated with the cylindrical walls of the plate, the other sides are associated with the cross-thickness walls (47 and 48) of the said plate.

In order to facilitate fixing by stops, the blocking walls of the stops do not bear on diametric axial planes, but are slightly inclined with respect to these planes. Thus, for the closure stop (11) at angular position $\phi$, the blocking wall (16) of the stop makes an angle ($\pi/2-\gamma 1$) with the diametric axial plane with angular position $\phi$, and for the opening stop (12) at angular position $\theta$, the blocking wall (17) of the stop forms an angle ($\pi/2-\gamma 2$) with the diametric axial plane at angular position $\theta$. For the plate, its cross-thickness walls (47 and 48) are not orthogonal with the cylindrical walls but each forms an angle ($\epsilon 1$ and $\epsilon 2$) with the diametric axial plane passing through the lower end at the corresponding angle ($\pi/2-\gamma 1$) or ($\pi/2-\gamma 2$), such that fixing is achieved when one of these cross-thickness walls is inserted in the dihedron comprising of the wall of the neck and the blocking wall of the corresponding stop.

Preferably, the height difference between the said opening and closure stops is equal to at least $P^*(|\theta-\phi|-\delta)/2\pi$.

The opening stop is fairly high and is preferably a ratchet tooth with an acute angle $\gamma 2$. The closure stop may also be a ratchet tooth oriented in the opposite direction with an acute angle $\gamma 1$, but an anchor stop with an L-shaped section is preferred if possible according to the dimensions; the blocking wall of the stop is used with a circumferential wall that traps the end of the axial plate, this end being inherently flexible in the radial direction to pass above the opening stop when screwing in the assembly and that could skip above the closure stop in the absence of this circumferential wall. Furthermore, the circumferential wall increases the friction area offered in contact with the axial plate, which improves the braking effect that occurs when close to the stop, improves retention of the axial plate in contact with the said stop and therefore improves retention of the overcap in the closed position.

The head and the overcap are preferably made of a thermoplastic material. The axial plate is advantageously moulded along the extension of the cylindrical skirt of the overcap. This skirt is provided with a screwing in means (for example one or several "nut" type threads) on its internal wall complementary to the screwing in means on the neck that comprises one or several helical threads ("screw" type threads). The skirt of the overcap must be rigid enough so that the "nut" type threads do not skip above the "screw" type threads. Consequently, the skirt of the overcap is advantageously reinforced by axial radial ribs if possible, depending on the size.

It is advantageous to mould a helical "screw" thread with a straight starting point on the neck, and a "nut" thread with a straight stopping point on the internal wall of the overcap skirt, to cooperate with the closure stop and to lock rotation of the overcap.

If the axial plate is moulded along the continuation of the line of the skirt, and if possible depending on the dimensions, the radial ribs that reinforce the skirt may also be prolonged, fixed to the outside wall of the axial plate to act as an audible warning as in U.S. Pat. No. 5,199,605, rather than to make the wall less flexible; a slit separates the end of the radial axial rib from the end of the axial plate. A pad is placed on the shoulder at the same distance from the axis as the said end of the rib and at an angle $\alpha$ of more than 10°, for example about 20°, from the opening stop (in the screwing in direction) or the closure stop (in the screwing out direction) in order to make the end of this axial rib vibrate. The audible warning may be provided for closing and opening. However in practice, it is not desirable to have too many audible effects for a limited rotation angle since it is no longer possible to identify the warning if they are too close. Thus, it is preferable to use a warning device only at one stop.

For the other stop on which there is no audible warning, a braking effect could be provided close to the stop; the user would feels a slight resistance to inform him or her that the overcap will shortly arrive at its stop. This braking effect is achieved by forming a wall that moves away from the cylindrical wall of the neck close to the stop in the limited rotation range. FIG. 1 illustrates a helical separation with angle $\beta$ between the axial plane tangent to the said wall and the axial plane tangent to the neck. This angle is necessarily small, to the extent that the radial height of the stop must be sufficient to maintain its blocking efficiency.

Each part of the head+overcap assembly according to the invention is made separately, preferably by the injection of a thermoplastic material in a mould. The head may be fixed to the open end of a container or a tube skirt at the time that it is formed (insert moulding). The assembly is then installed by screwing the overcap on the head.

Due to the dimensional manufacturing tolerances, the screwing in angle that brings the axial plate into a limited rotation range during assembly (in other words the space between the opening and closure stops) is not perfectly repetitive, which is a handicap for large production series. n sets of stops could be made on the head in order to maintain maximum flexibility in manufacturing at high production rates, with the closure stop being located along the radial extension of the opening stop, but not as high. The limited rotation is then $(2\Pi/n)-\delta$ if there are n (opening stop, closure stop) pairs on the shoulder and n axial plates on the overcap. Thus, if the axial plate that is radially flexible overlapped a stop, it will be located in a new trapping area offset from the previous trapping area by $(2\Pi/n)$.

Furthermore, cooperation of n plate blocking points enables the use of lower radial stops and more compact plates. But if the stops are to remain efficient, the range of their blocking wall, an approximately diametric portion of an axial plane, must be sufficiently large, which imposes a minimum radial height, taking account of the necessary clearance between the inner cylindrical wall of the plate and the outer cylindrical wall of the neck, and taking account of the inevitable fillets equal of a few tenths of a millimeter on the moulded convex parts of stops and the plate. In practice, the objective is that the radial height of the stop should be such that the firm fixed stop area is equal to the clearance between the inner cylindrical wall of the plate and the outer cylindrical wall of the neck.

The head of the container or the tube may or may not be made of plastic, for various reasons. In this case, the assembly according to the invention is in the form of a "base+overcap" assembly, the base being an intermediate part with elements characteristic of the head described in this invention in its upper part, and non-plastic attachment means to the head in its lower part.

EMBODIMENTS OF THE INVENTION—EXAMPLES

In the following examples, we have chosen flexible tubes with small dimensions such that the preferred number n of pairs of opening/closure stops is equal to 2.

In examples 1 and 2, it can be seen that the small size and low weight possible due to these opening/closure stops and these flexible plates makes "centerlock" systems more comfortable in use.

In examples 3 and 4, elements are added to perform additional functions, and introducing new flexible tubes; the first is a sun cream distributor in which sun cream is distributed by the deformation of an elastomeric wall, and has a head which makes the closure perfectly safe when the tube is placed in a carry bag even without an outer cap, and the second is a metallic distribution tube for a cyanoacrylate based glue that is very sensitive to humidity.

As we have seen, FIG. 1 diagrammatically shows the various attachment means according to the invention in a section through a plane orthogonal to the centreline of the neck, at the bottom of the neck. The axial plate and the radial rib are the only parts of the overcap shown. This figure is a top view representative of the device used in example 3. It is also representative of example 2, if the positions of the audible pad 15 (that should be placed close to the opening stop 12) and the lock β (to be placed on the closure stop 11) are inverted.

FIG. 2 shows a first embodiment according to the invention (example 1) in which the head is provided with two diametrically opposed pairs of opening/closure stops and in which the radial height has been exaggerated to improve the readability of the figure. This head is illustrated in a front view and the overcap is shown in a section through an axial diametric plane passing through the pairs of stops and the audible warning pads.

Figure 6A:
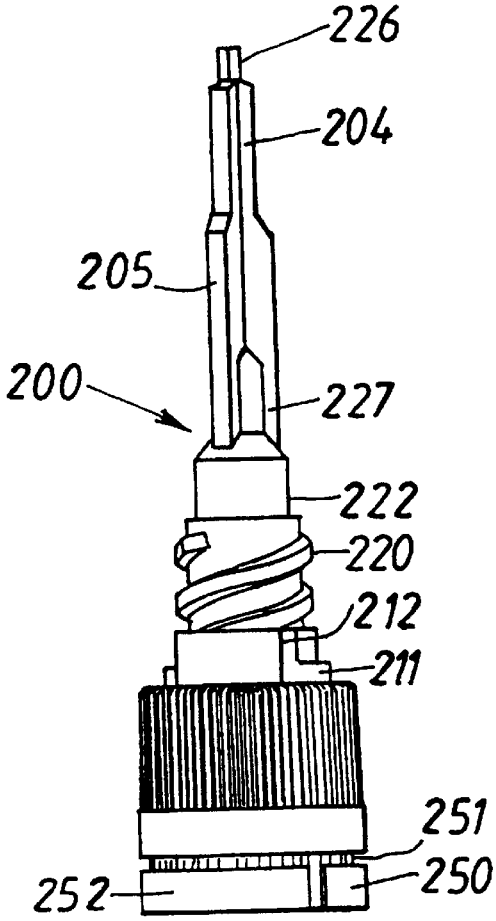
Figure 7A:
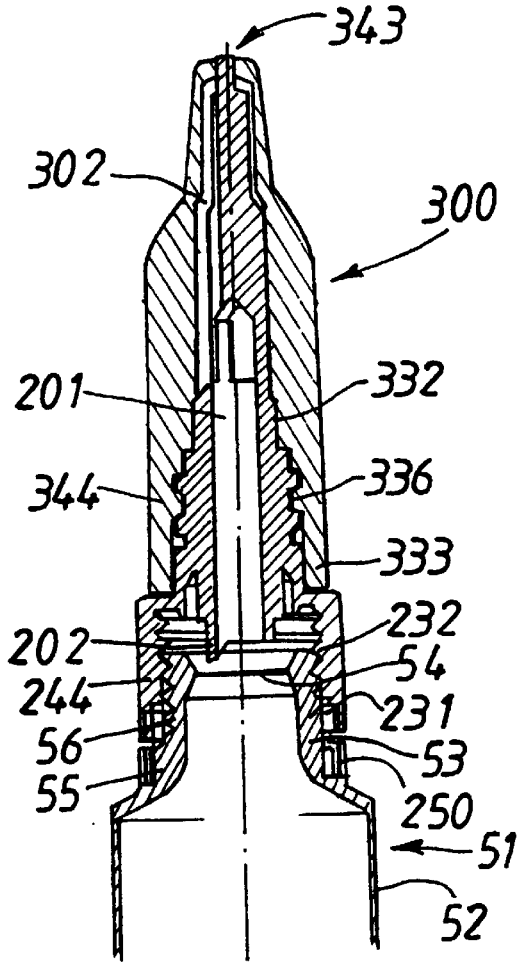
Figure 6B:
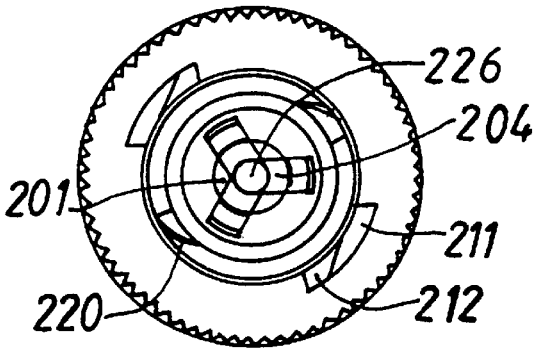
Figure 7B:
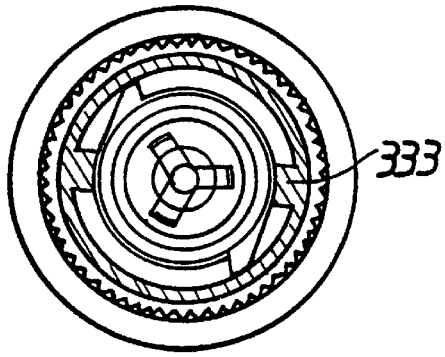

FIGS. 6 and 7 show a fourth embodiment according to the invention (example 4). FIG. 6*a* is a front view of the base, an intermediate part made of a plastic material that can be fixed on a head of the metallic tube. FIG. 7*a* shows an axial section through the "metallic tube head/base/hollow needle" assembly before it is used for the first time. FIG. 6*b* is an orthogonal section through the base and FIG. 7*b* is a top view of the base associated with an orthogonal section through the hollow needle, the orthogonal sections being made at the means for irreversible attachment of the hollow needle on the end piece with limited rotation.

Example 1

Figure 2:
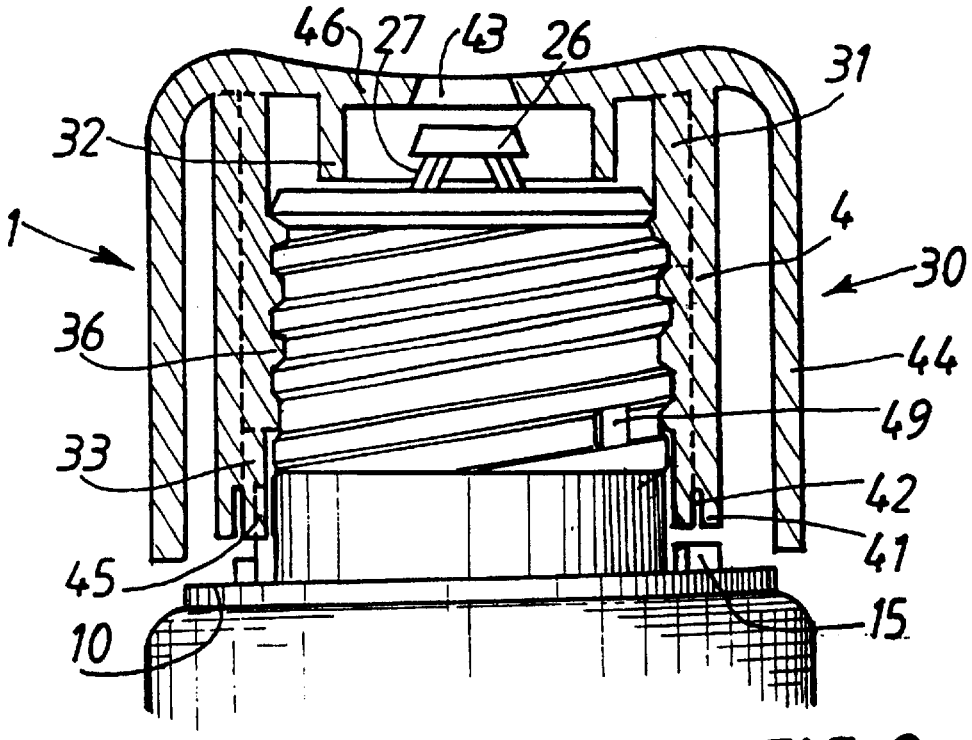

"Centerlock" Tube (FIG. 2)

This is a "head+cap" assembly with the same functions and the same external appearance as the "Centerlock" tube described in U.S. Pat. No. 5,199,605. It is intended to equip distributor tubes with products that are not too liquid, with viscosity such that they have a creamy to pasty behaviour. The attachment system according to the invention reduces the weight of the tube head which improve its usage comfort.

Head 1 is made of a high density polyethylene and has been insert moulded with a 0.4 mm thick 35 mm diameter flexible skirt 50. This skirt is provided with an 18 mm high 18 mm diameter neck 20 threaded in the middle part (triple thread 21 with pitch P=9 mm) with a height of 8 mm. The thread is fitted with a straight stop 49. The neck is fitted with three pairs of stops located at 120° from each other at the bottom of the thread. For each pair:

- the opening stop 12 is 7 mm high; it is in the form of ratchet teeth with opening angle $\gamma 2=80°$;
- the closure stop 11 is 2 mm high and is located along the radial extension of the opening stop, with an L-shaped that is more easily fixed.

The 5 mm diameter closer 26 is held in place by oblique arms 27 with a 1.5*3 orthogonal rectangular section fixed on the inside wall of the neck. The difficulties in making such a head make it necessary to have a neck wall at least 2 mm thick in order to obtain industrial acceptable injection conditions.

The flat shoulder 10 is provided with three pads 15 offset by 20° from the opening stops 12 in the screwing in direction, to provide an audible warning when screwing out.

The overcap 30 is moulded separately and is made of polypropylene. The diameter of its outer skirt 44 is 35 mm and its thickness is 1.5 mm. It is also provided with a 3 mm high sealing skirt 32 with an outside diameter of 14 mm; it is inserted into the inner wall of the neck without any clearance. The overcap is also provided with an inner skirt 31 with an outside diameter=22 mm provided with a 14 mm high thread 36 on its inner wall (diameter on thread ≈20), complementary to the thread 21 on the neck.

Two 1 mm thick, 5 mm wide, 20 mm long radially flexible and circumferentially rigid axial plates 33 are fixed to the bottom of overcap 30', fixed over the 14 mm height of the inner skirt 31 and extending for another 6 mm (opening angle δ≈6.5°). The shape of their section is a curved trapezium.

Two ribs 34 with the same length as the axial plates are arranged radially (radial height 2.5 mm thickness 1 mm) adjacent to the axial plate 33 and reinforcing the full height of the inner skirt 21. Their free ends are provided with a 2.5 mm high axial slit 42 releasing a circumferentially flexible end 41 about 2 mm wide, which cooperates with the pad 15 placed on the shoulder 10 at about 20° in the screwing in direction to produce an audible vibration to inform the user that the opening stop 12 is not far away.

The product is distributed through the central orifice 43 of the overcap 30, closed by the central closer 26 when the overcap reaches the closure stop 11 and released by the closer 26 being lowered with respect to overcap 30 when the overcap reaches the opening stop 12. The axial displacement of the top wall 46 of the overcap 30 with its orifice 43 concentric with the closer 26 fixed to the head, is due to the helical movement driven by the limited rotation of the overcap with respect to the head.

The conical shape of the wall of the central closer 26 regulates the distribution flow by varying the degree of opening of the overcap 30, for which the rotation is limited to 112.5°.

Example 2

Figure 1:
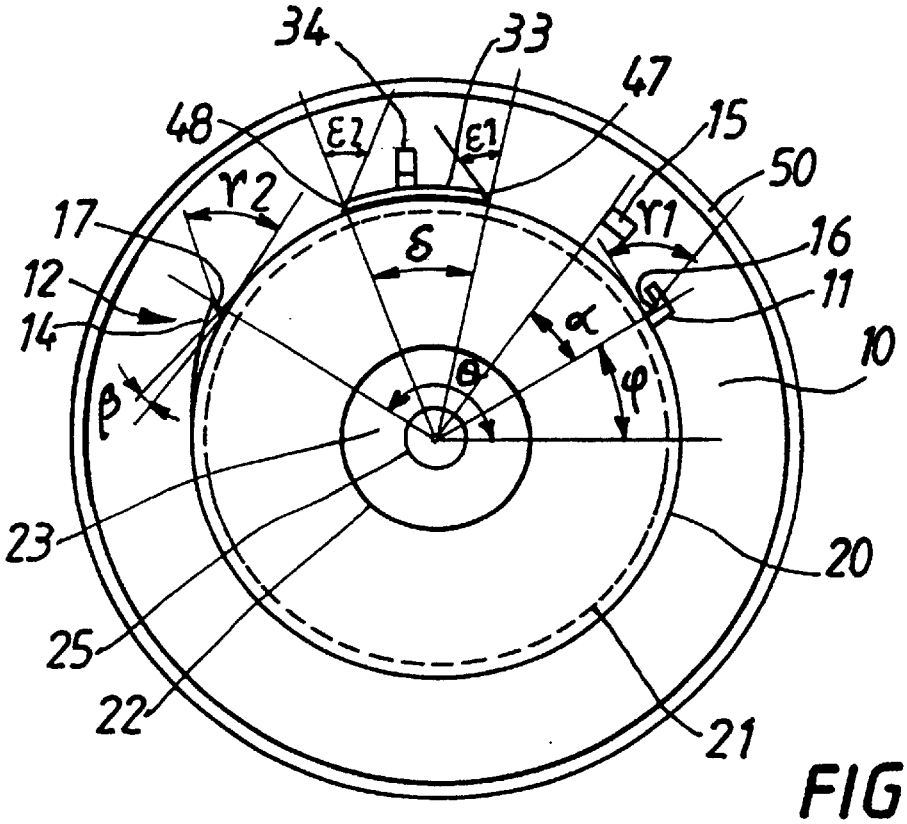
Figure 3:
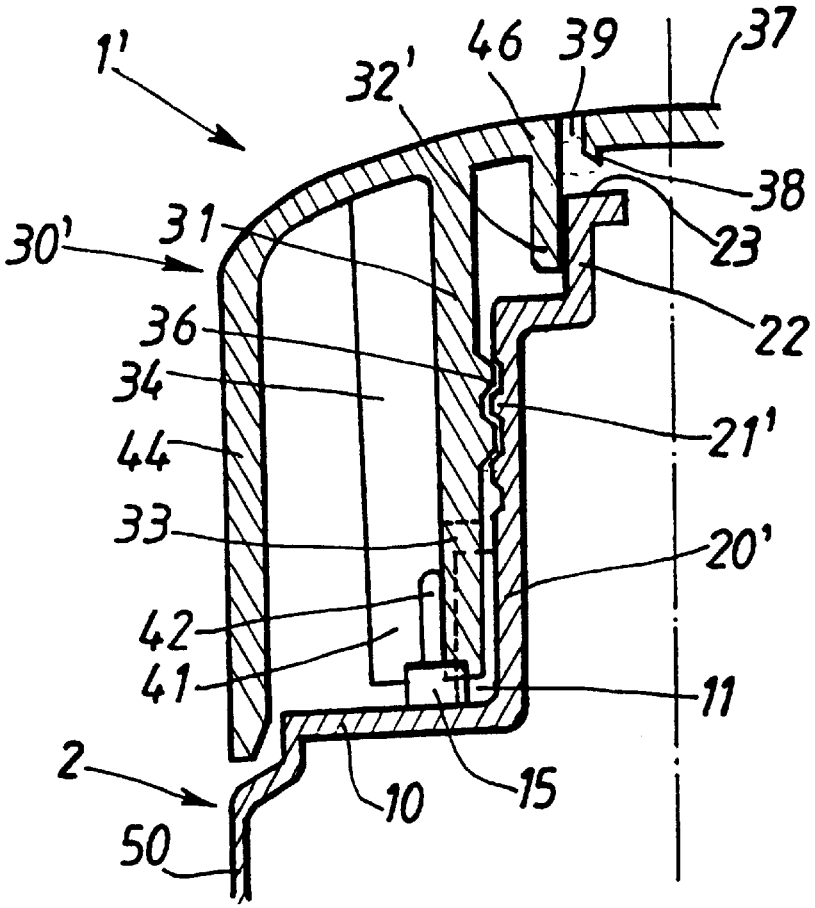
FIG. 3 shows a second embodiment according to the invention (example 2) as an axial half-section.

Cream Distribution Tube With Central Annular Slits (FIG. 3 and FIG. 1)

Unlike the head in example 1, the product is not distributed through a central orifice 43 of the overcap that may or may not be closed by a central disk 26 held in place by arms 27 that occupy space inside the neck. A circular central wall 37 is isolated from the rest of the top part 46 of the overcap 301 by one of the 2 mm wide annular slits 39 uniformly distributed over an 8 mm diameter, and separated by long material bridges. There are six in this special case, and they are not more than 1 mm long in the circumferential direction.

An annular thickening 38 formed on the inside of the overcap is attached to the periphery of the central circular wall 37.

A cylindrical attachment 22 is fitted on top of the neck with a top wall 23 that delimits a 4 mm diameter orifice 25. In the closed position, the annular thickening 38 at the periphery of the central circular wall 37 bears on the top surface 23 of the neck. The diameter of the annular thickening 38 is close to 6 mm, and its height is of the order of 0.5 mm.

The overcap 30' is made of polypropylene and is moulded separately. The diameter of its outer skirt 44 is 35 mm and it is 1.5 mm thick. It is also provided with a sealing skirt 32' that permanently overlaps the cylindrical attachment 22 regardless of the position of the overcap 30' with respect to the head.

The overcap 30' also has an inner skirt 31 with an outside diameter=22 mm, provided with a 14 mm high thread 36 (inside diameter on thread≈20) complementary to the thread 21' on the neck (single thread with 3 mm pitch).

Two 1 mm thick, 5 mm wide, 20 mm long radially flexible and circumferentially rigid axial plates 33 are fixed to the bottom of overcap 30', fixed over the 14 mm height of the inner skirt 31 and extending for another 6 mm (opening angle δ≈6.5°). The shape of their section is a curved trapezium.

Two ribs 34 the same length as the axial plates, are arranged radially (radial height 2.5 mm, thickness 1 mm) adjacent to the axial plates 33 and reinforcing the inner skirt 21 over its full height. The free ends have a 2.5 mm axial slit 42 releasing an approximately 2 mm wide circumferentially flexible end 41 that cooperates with the pad 15 placed on the shoulder 10 at about 20° in the screwing in direction, to emit an audible vibration to inform the user that opening stop 12 is not far away.

The product is distributed through annular slits 39. The product is prevented from passing by the peripheral thickening 38 that presses on the top part 23 of the neck when the overcap 30' is held in place by the closure stop 11. The passage opens up when the thickening 38 moves away from the top part 23 of the neck when the overcap is unscrewed, and then reaches the opening stop 12.

The global geometries in this example and in the previous example are identical (a flexible tube with 35 mm diameter skirt). Two pairs of opening/closure stops are used oriented at 180°. The opening stop 11 is accompanied by an audible warning device (pad 15 at 20° in the screwing in direction). The closure stop 12 is an L-shaped fixing stop.

Figure 4:
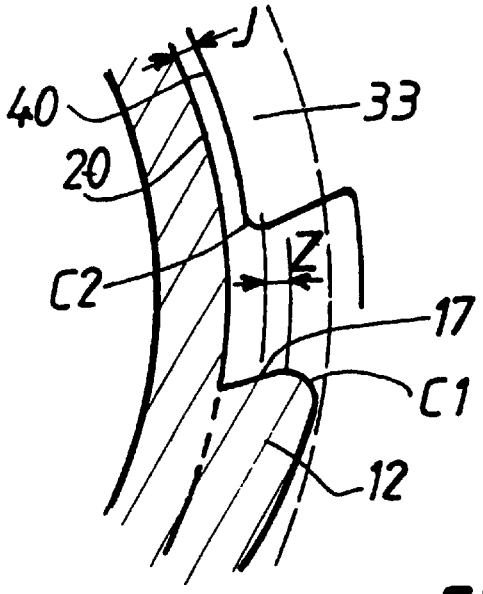
FIG. 4 shows an orthogonal section illustrating the elements to be considered to determine the minimum radial height of a stop.

FIG. 4 shows that the radial height H of the stop, in this case of the order of 1 mm, is sufficient to leave a firm stop area Z equal to at least 0.5 mm, taking account of the clearance J between the inner cylindrical wall 40 of the plate 33 and the outer cylindrical wall of the neck 20 (or 20') and fillets C1, C2 equal to a few tenths of a millimeter on the moulded convex parts of the stop 12 and the plate 33.

Example 3

Figure 5:
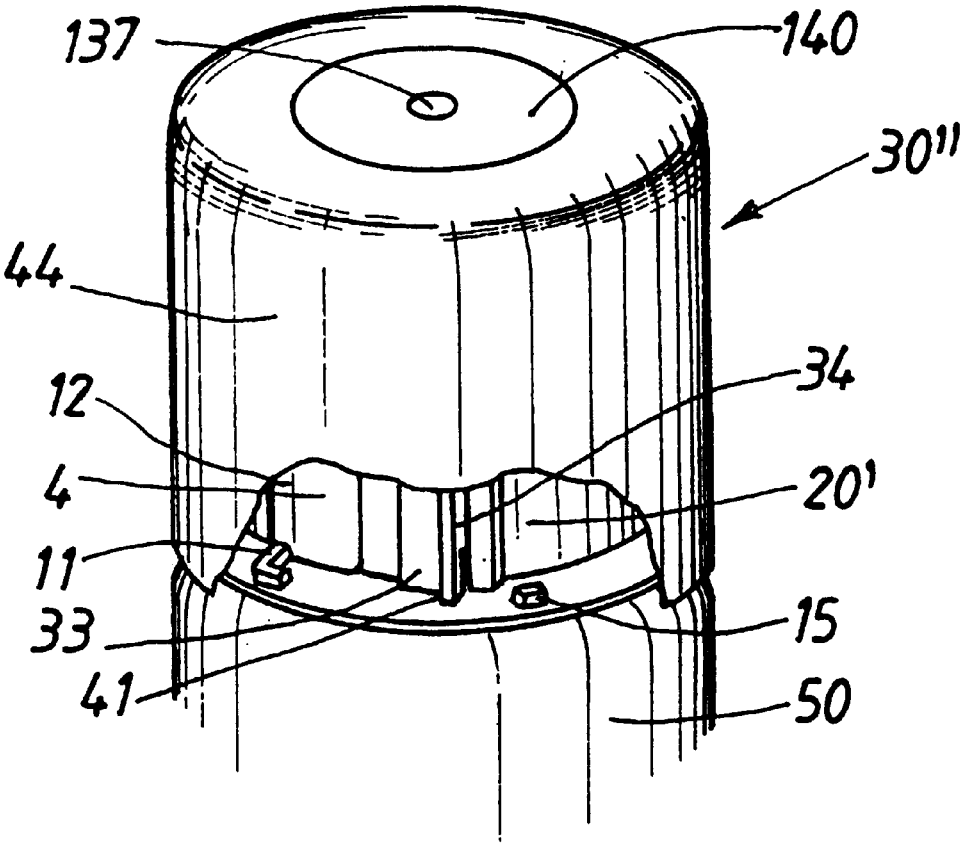
FIG. 5 shows a perspective view of a third embodiment according to the invention (example 3), part of the overcap having been removed to show the attachment system.

Leakproof, Sandproof sun Cream Distribution Tube Without Outer Cover (FIG. 5 and FIG. 1)

This tube is illustrated in FIG. 5 and is provided with an irreversible attachment system with limited rotation according to the invention already described in the previous examples, that are advantageously complementary to a distribution device such as that described in FR-A-2 758 127. This device comprises a valve composed of a flexible wall 140 through which a central hole is formed and a support structure 137, located through the passage formed by the neck supported by the overcap 30'.

The central hole in the flexible wall 140 is closed off when the container is at rest, in other words the edge of the central hole in the flexible wall 140 is naturally in intimate contact on the support structure 137 of the valve over the entire contact surface and forms a leakproof valve preventing the product from escaping.

When pressure is applied on the flexible wall of the tube, the wall 140 deforms breaking the leakproof contact between the said wall and the support structure 137 and forming an opening between them through which the product can escape. Thus, the result is selective distribution of the product at a variable rate depending on the pressure applied to the skirt of the tube.

The device is efficiently leakproof when no pressure is applied on the tube. It prevents the product from coming out, and also prevents any impurities (sand, dust) from entering. Therefore the product remains unpolluted, which is an important advantage for the consumer.

The support structure 137 is in the form of a fixed non-deformable pin, while the flexible wall 140 surrounding the orifice is made of an elastomeric thermoplastic material.

The result is a tube that is pleasant and easy to use, soft to the feel, that can be used with only one hand if necessary and that automatically "closes" as soon as pressure is no longer applied to its walls. However, the tube according to FR-A-2 758 127 is not protected from shocks or blows, particularly during transport, and a leaktight outer cover is necessary due to this lack of safe closure.

The attachment system according to the invention eliminates the need for the outer cover.

The head is perfectly identical to the head in example 2, with a neck 20' on top of which a cylindrical attachment 22 is formed provided with a top wall 23 that delimits a 4 mm diameter orifice 25.

The valve (wall+support structure) is fixed to the overcap 30". The overcap 30", apart from the top part supporting the said valve, is identical to the overcap 30' in the previous example 2. The diameter of its outer skirt 44 is 35 mm and it is 1.5 mm thick. It is also provided with a leaktight skirt (32', FIG. 3) that permanently overlaps the cylindrical attachment (22, FIG. 3) of the neck, regardless of the position of the overcap 30" with respect to the head. As in FR-A2 758 127, the top part of the overcap is provided with an elastomeric membrane 140 supported on a central pad 137.

There is an annular thickening formed in relief on the inside of the overcap similar to the thickening 38 in example 2, on the lower face of the central pad 137.

As in example 2, the thickening (38, FIG. 3) of the overcap bears on the top wall (23, FIG. 3) of the neck, when the overcap is in the closed position. Since no product can pass through, the elastomeric membrane 140 does not deform even if an accidental pressure is applied on the tube wall. Therefore, the product cannot escape and the overcap 30" provides a perfectly safe closure during transport.

In the open position, the passage between the membrane 38 and the top wall 23 of the neck is free and the distributor acts as described in patent application FR 2 758 127.

FIG. 5 shows a perspective view of the top of the leakproof sandproof tube in the example, part of the overcap having been removed to show the attachment system comprising of a pair of stops comprising of an opening stop 12 and a closure stop 11, the radially flexible plate 33, a pad 15 coming into contact with the circumferentially flexible end 41 of the radial rib 34.

In this case, the audible warning function is used to inform the user that the tube is in the closed position. When the user hears this signal, he can safely put his tube in a carry bag.

Example 4

Tube of Cyonoacrylate Based Glue (FIGS. 6*a*, 6*b* and FIGS. 7*a*, 7*b*)

This tube illustrated in FIGS. 7*a* and 7*b* is also provided with the irreversible attachment system with limited rotation according to the invention, in this case adapted by using an intermediate plastic insert 200 illustrated in FIG. 6*a* and 6*b*, between the cap-hollow needle 300 and the metallic tube head 51.

The tube in this example is intended for packaging of particularly strong adhesives such as cyanoacrylate based products. Due to its end in the form of a hollow needle, it can be used to deposit a controlled quantity of product in a precise location. It is a smaller tube (13.5 mm wall diameter) than the previous tubes. It illustrates use of the attachment system according to the invention under more difficult geometric conditions. Under these conditions, it is not provided with an audible warning device.

There is no reason why a tube with a system identical to the above tubes cannot be made if possible depending on the dimensions (flexible tube with 35 mm diameter wall for application of cosmetic products (for example hair colouring) or ophthalmologic products, etc.). In both cases, the cap-hollow needle will preferably be provided with a rounded application end that cannot cause injury.

It is in the form of a metallic tube provided with a neck, the orifice of which is closed off by a closer that keeps the product inside the tube and protected from air before its first use.

DE 41 26 477 describes a tube for this purpose made of an aluminium alloy onto the head of which a plastic hollow needle is fixed, delivered with an overcap provided with a sufficiently long needle so that it can perforate the closer once it is inserted inside a capillary duct. Therefore the first time it is used, this type of needle is used to perforate the closer and subsequently to close off the orifice in the hollow needle.

With this type of tube, the product inside the tube may be expelled outwards after closing when the needle has to be reinserted in the capillary duct. In this case it is difficult to clean the edge of the hollow needle that gradually becomes closed off by hardened glue. The irreversible attachment system with limited rotation according to the invention avoids this type of problem, and its compactness makes it possible to use a new arrangement of elements participating in controlled distribution of the product.

The tube according to the invention also uses a needle but is not fitted with an overcap since it operates like the "centerlock" in example 1, the overcap 30 being in the form of a hollow needle 300 and the closer (26, FIG. 2) being in the form of a needle 226, the length of which is similar to the length of the hollow needle, and such that it projects slightly beyond the end of the hollow needle in the closed position.

There is no reason why the needle should not be concentric with the plastic neck. In this case, the packaged product is a glue that is highly sensitive to humidity and that must be kept in a closed metallic tube if it is to be kept for a long period. This is why in this case an intermediate part 200 is used that will perforate the closer at the time of first use and will then be firmly fixed onto the metallic head to subsequently act as the container head in the previous example. In the following, we will refer to this intermediate part with multiple functions as the "base".

The base is provided with four parts, two central parts (upper and lower) and two peripheral parts (upper and lower).

The lower central part of the base 200 is a central duct 201 extending downwards by a tube with a diameter of about 4 mm, in which the bevelled bottom part 202 perforates the metallic closer 54 after the base 200 is fully screwed onto the neck 53 of the metallic tube 51. After the closer has been perforated, the product packaged in the tube will pass through the inside of this central duct 201.

The needle 226 is the upper central part of the base 200. The height of this needle 226 is approximately 18 mm and it has a three-part progressive shape; at the top it is a cylindrical closer with a diameter of about 1 mm and about 1.5 mm high; in the middle it is supported by three approximately 0.8 mm thick uniformly distributed radial ribs 204 on the side of the needle over a height of about 15 mm; in the lower part, the central part is hollow, aligned with the central duct 201, and the bases 227 of the ribs 204 form a sort of tripod through which the needle is supported on the peripheral wall of the central duct 201. The space between the bases 227 of the ribs provides a large passage for the product to be distributed between the central duct 201 and the inner duct 302 of the hollow needle 300.

The upper peripheral part of the base 200 is similar to the cylindrical neck in the previous examples; at the top, the diameter of the attachment 222 is 4.5 mm, and it is smooth over a height of 3 mm. The lower threaded part has a double helical thread 220 over a height of 5 mm with a pitch close to 6 mm. The base 210 is provided with two diametrically opposite pairs of (opening stops 212/closure stops 211). The height of the opening stops 212 is 3 mm; they are in the form of ratchet teeth. The closure stops 211 are 1 mm high and are also in the form of ratchet teeth facing the direction opposite to the direction of the opening stops 212.

The lower peripheral part of the base 200 is a screwing in skirt 244 that is also used for fixing onto the head of the metallic tube. A helical thread 232 is formed on the inner wall of its upper part, complementary to the screwing in thread 56 on the metallic tube. In its lower part, its inner wall is provided with 12 ratchet teeth 231 that are elastically deformable in the screwing in direction and are designed to fix the base onto the head of the metallic tube 51 operating in cooperation with the teeth 55.

The tube 51 is a metallic tube with a skirt 52 that has an outside diameter of 13.5 mm. The thread diameter of the 8 mm high metallic neck 53 is about 9 mm. A 5 mm diameter closer 54 is placed on the top of the tube. A helical thread 56 is formed on the top part of its outer wall with a pitch of about 1.3 mm, complementary to the thread 232 on the base. Near the bottom, it is provided with eight ratchet teeth 55 intended to fix the base at the end of penetration by screwing in, after perforation of the closer 54, by blocking the ratchet teeth 231. The orientation of these teeth 231 is opposite to the orientation of the teeth 55. More generally, the number of teeth 231 and the number of teeth 55 will be chosen such that their lcd (largest common divider) is greater than or equal to 3, to give good attachment of the base on the head.

The hollow needle 300 is provided with an outer skirt 344 threaded on its inner wall near the bottom, and with knurling ribs 301 in its upper part, that are gripped to turn it about the centreline of the base. It has an inner duct 302 through which the product passes to the distribution orifice 343. In the lower part, a reaming 332 is slid onto the cylindrical attachment 222, slightly tight. Nearer the top, there is the inner duct 302 itself for which the diameter of the wall 303 gradually reduces as the product gets closer to the orifice; this diameter varies from 3 mm near the bottom to about 1 mm at the orifice 343.

The ribs 204 that reinforce the needle 226 have a peripheral wall 205 that matches the shape of the wall 303 of the inner duct 302, with a clearance of a few tenths of a millimeter. Thus, after removing the closer and when pressure is applied onto the tube wall 52, the product is forced through the inner duct 201, the passage between the arms 227 that hold the needle 226 in place, then the space between the wall 303 of the inner duct 302, the needle 226 and ribs 204, and finally into the thin end of the inner duct 302 to pass out through the orifice 343.

During use, the user deposits a controlled quantity of glue at a precise location. After use, he screws in the hollow needle 300 which has the effect of bringing the end of the needle 226 into the orifice 343. Due to cooperation between the helical threads 336 and 220, the limited rotation enables a relative axial displacement between the cap/hollow needle 300 and the needle 226, which moves the needle 226 towards or away from the orifice 343. The needle 226 thus acts as a closer. After closing, the length of the needle is such that it projects slightly (by at least several tenths of a millimeter) beyond the top of the hollow needle. It will be seen that a certain amount of product was drawn in during closure, since the quantity of the product forced outwards due to the upwards movement of the needle with respect to the hollow needle is less than the quantity contained in the capillary duct. Furthermore, this small quantity of glue may easily be removed if there is no outer cover.

The next time that the tube is used, unscrewing of the hollow needle 300 firstly releases the orifice 343, but also stirs the glue close to the orifice due to the relative movement of the needle 226 and the ribs 204 with respect to the wall 303 of the inner duct 302.

The end of the needle 226 is cylindrical, which enables a certain angular movement (therefore initial mixing of the glue through ribs 204) before the capillary duct is released and glue is expelled.

The hollow needle 300 is made separately and is then assembled by screwing onto the base 200. After screwing onto the base, the plates 333 reach the limited rotation area delimited by the opening stop 212 and the closure stop 211. In this case, due to the size and dimensions, the plates 333 are adjacent to the outer skirt 344 of the hollow needle. Therefore, before it is screwed onto the metallic tube head, the hollow needle 300+base 200 assembly is already provided with irreversible attachment means in the axial direction enabling limited rotation of the hollow needle with respect to the base.

The base 200+hollow needle 300 assembly is delivered partially screwed onto the head of the metallic tube 51 at the packager. The consumer does not complete the screwing in movement until he uses it for the first time; this imposes an axial movement penetrating the base and attachment of the base onto the tube head after the closer has been perforated.

In order to prevent any accidental penetration of the base before the first use, a safety ring can be inserted between the base 200+hollow needle 300 assembly and the head of the metallic tube 51. In this case, the user firstly unscrews the hollow needle, removes the ring and then screws it all the way in again to remove the closer and fix the base.

In this example, the ring is replaced by a tamperproof means 250 attached to the skirt 244 of the base 200. This tamperproof means corresponds to the means described in EP 0 475 354: a guarantee strip 252 is connected to the skirt 244 through breakable bridges 251. It is provided with inner teeth that cooperate with the ratchet teeth 55 on the neck 53 of the metallic tube. These inner teeth can be elastically inclined in the screwing in direction so that the base can be screwed in without breaking the breakable bridges, and then to prevent the base from being unscrewed until the bridges have broken. To facilitate breakage of the bridges 251, the number of inner teeth is preferably chosen such that there is no common multiple between this number and the number of teeth 55 on the metallic neck. Preferably, the guarantee strip 252 is not continuous; its two free ends enable it to move free sideways the first time that it is unscrewed. Under these conditions, the user unscrews the base by at least one turn to detach the guarantee strip and then screws it in fully to perforate the closer.

The hollow needle may also be extended by a breakable closer; the breakable area surrounds the end of the needle.

Advantages of the Process According to the Invention lighter weight container heads with irreversible attachment and limited rotation;

more compact container heads with irreversible attachment and limited rotation;

container heads with irreversible attachment and limited rotation that are simpler and faster to make (manufacturing rate double the rate possible according to prior art);

lower quantity of product to be distributed forced outwards after the pressure is removed (less dirt);

new functions possible; safe transport of sandproof tops without an outer cap; application to tops in the form of hollow needle; application for products sensitive to humidity or contact with air in general, without the need for outer caps; clean surroundings around the distribution orifice.

What is claimed is:

1. Assembly comprising of a head (1, 1') and an overcap (30, 30', 30", 300), said head having one open end (2) designed to be fixed on the open end of a container or a flexible tube provided with a cylindrical neck (20, 20') and a shoulder (3) extending from the said open end to said neck, in which the cylindrical neck is provided with at least one helical screw thread (21) with pitch P, and in which the overcap has a cylindrical skirt provided with thread (36) on its inner wall complementary to the thread (21) on the neck (20), characterised in that said overcap has at least one radially flexible and circumferentially rigid axial plate (33), one end of said flexible plate being free, the other end being fixed to the top wall (46) of the overcap at a distance from the centreline slightly greater than the outside radius of the neck, and in that the bottom (10) of the neck is provided with at least one opening stop (12) and at least one closure stop (11) that is not as high, said opening stop being provided with a first wall (14) that gradually moves away from the cylindrical skirt of said neck, such that when the overcap (30) is screwed onto the head for putting the assembly together, the free end of the axial plate comes into contact with the first wall (14) and in that the free end is forced to move centrifugally and is elastically deformed and then, after passing beyond the opening stop, moves downwards towards the cylindrical wall of the neck inside a space between said opening stop (12) and closure stop (11), and in this case its movement is limited by the blocking walls (16 and 17) of said stops (11 and 12).

2. Assembly comprising of a head (1, 1') and a overcap (30, 30', 30", 300) according to claim 1, characterised in that said blocking walls (17 and 16) of the opening stop (12) at angular position θ, and the closure stop (11) at angular position ϕ, are slightly inclined with axial diametric planes at angular positions θ and ϕ respectively and cooperate with the wall (47 or 48) of the axial plate (33) that comes into contact with them such that the free end of the axial plate (33) is forced to move according to a centripetal movement.

3. Assembly comprising of a head (1, 1') and an overcap (30, 30', 30", 300) according to claim 1, characterised in that the axial plate (33) matches the shape of the portion of a ring with an average radius slightly greater than the average radius of the neck, the orthogonal section being a curved trapezium in which the small base and the large base are the arcs of a circle with an opening angle equal to 6, the large base being facing inwards.

4. Assembly comprising of a head (1, 1') and an overcap (30, 30', 30", 300) according to claim 1, characterised in that the difference in height between the opening stop (12) and the closure stop (II) is equal to at least $P^*(|\theta-\phi|-\delta)/2\pi$.

5. Assembly comprising of a head (1, 1') and an overcap (30, 30', 30", 300) according to claim 1, characterised in that said opening stop (12) and closure stop (11) are ratchet teeth or L-shaped anchors.

6. Assembly comprising of a head (1, 1') and an overcap (30, 30', 30", 300) according to claim 1, characterised in that the axial plate (33) is moulded along the extension of the skirt (31) used to screw in the overcap and in that this skirt (31) is reinforced by at least one axial rib (34) oriented radially and in contact with said axial plate.

7. Assembly comprising of a head (1, 1') and an overcap (30, 30', 30", 300) according to claim 1, characterised in that the neck is provided with a helical "crew" thread with a straight thread at the beginning and in that the inner wall of the skirt (31) of the cap is provided with a "nut" thread with a straight thread at the end.

8. Assembly comprising of a head (1, 1') and an overcap (30, 30', 30", 300) according to claim 6, characterised in that the axial rib (34) has a lower end (41) separated from the plate by a circumferentially flexible slit (42) that acts as a flexible plate providing an audible warning when it comes into contact with a pad (15) located on the shoulder at the same distance from the centreline of the neck as the lower flexible end (41) of the axial rib (34) and located at an angle a of more than 10 degrees in the screwing out direction of the closure stop (11) or in the screwing in direction of the opening stop (12).

9. Assembly comprising of a head (1, 1') and an overcap (30, 30', 30", 300) according to claim 1, characterised in that the stop is provided with a lock, in other words a wall that moves away from the cylindrical wall of the neck in the limited rotation area.

10. Assembly comprising of a head (1, 1') and an overcap (30, 30', 30", 300) according to claim 1, characterised in that the neck is provided with n sets of stops, the closure stop being located along the radial extension of the opening stop and in that the cover is provided with n axial plates.

11. Assembly comprising of a head (1') and an overcap (30', 30") according to claim 1, characterised in that the neck (20') is provided with a top wall (23) that surrounds the orifice (25) and in that said overcap has a central wall (37), an annular thickening (38) being attached on its inner surface, said thickening bearing on the top surface (23) of the neck (20') when in the closed position.

12. Tube provided with a head and an overcap which, when partially unscrewed, separates the top of the cap from the top of the head and thus releases a central orifice (43) through which the product is distributed, characterised in that it is provided with an assembly comprising of a head (1) and the overcap (30) according to claim 1.

13. Tube provided with a head and an overcap which, when partially unscrewed, separates the top of the overcap from the top of the head, characterised in that it is provided with an assembly comprising of a head (1') and an overcap (30', 30") according to claim 11.

14. Distribution tube for creamy or pasty products through central circular slits, characterised in that it is provided with an assembly comprising of a head (1') and an overcap (30") according to claim 11.

15. Distribution tube for creamy or pasty drip proof and sandproof products, characterised in that it is provided with an assembly comprising of a head (1') and an overcap (30') according to claim 11.

16. Assembly comprising of a head and a cap according to claim 1, characterised in that the overcap is in the shape of a hollow needle (300) and in that the head is extended by a needle (226).

17. Assembly comprising of a metallic head (51), a base (200) made of plastic material and an overcap (300), characterised in that the metallic head (51) and the base (200) are provided with means (231 and 55) cooperating together to irreversibly fix the base (200) onto the metallic head (51) and in that the base (200) and the cap (300) are provided with means according to claim 1, in which the base (200) acts as the head.

18. Assembly comprising of a metallic head (51), a plastic base (200) and an overcap (300) according to claim 17, characterised in that the overcap is in form of a hollow needle (300) and in that the base (200) is extended by a needle (226).

19. Assembly comprising of a metallic head (51), a plastic base (200) and an overcap (300) according to claim 18, characterised in that the length of the needle (226) is such that the needle (226) projects by at least several tenths of a millimeter beyond the top of the hollow needle (300), when in the closed position.

20. Assembly comprising of a metallic head (51), a plastic base (200) and an overcap (300) according to claim 18, characterised in that the hollow needle (300) is extended by a breakable closer in the form of a stick.

21. Assembly comprising of a metallic head (51), a plastic base (200) and an overcap (300) according to claim 17, characterised in that the metallic head is provided with a neck (53) in which the orifice is closed off by a closer (54) and in that the base is provided with a central duct (201), the lower end (202) of which perforates the closer (54) of the metallic head (51) during first use.

22. Assembly comprising of a metallic head (51), a plastic base (200) and an overcap (300) according to claim 18, characterised in that the base (200) is provided with tamper-proof means (250).

23. Assembly comprising of a metallic head (51), a plastic base (200) and an overcap (300) according to claim 18, characterised in that a ring is inserted between the base (200) and the metallic head (51) before the first use.

24. Metallic distribution tube, characterised in that it is fitted with the assembly comprising of a metallic head (51), a plastic base (200) and an overcap (300) according to claim 17.

* * * * *